US006342115B1

(12) United States Patent
Pourmand et al.

(10) Patent No.: US 6,342,115 B1
(45) Date of Patent: Jan. 29, 2002

(54) LAMINATING HEATING MODULE

(76) Inventors: Nasser Pourmand, 6316 Alonzo Ave., Encino, CA (US) 91316; John James Boyer, 20960 Quail Cir., Yorba Linda, CA (US) 92886

( * ) Notice: Subject to any disclaimer, the term of this patent is extended or adjusted under 35 U.S.C. 154(b) by 0 days.

(21) Appl. No.: 09/376,997

(22) Filed: Aug. 18, 1999

(51) Int. Cl.[7] ..... B30B 5/06

(52) U.S. Cl. ..... 156/64; 156/359; 156/583.1; 156/583.4; 156/583.5; 100/308; 100/309; 100/311

(58) Field of Search ..... 156/64, 228, 359, 156/580, 583.1, 583.4, 583.5; 100/43, 306, 307, 308, 309, 311, 151

(56) References Cited

U.S. PATENT DOCUMENTS

| | | | | | |
|---|---|---|---|---|---|
| 4,311,549 | A | * | 1/1982 | Vercillo | 156/308.2 |
| 4,398,991 | A | * | 8/1983 | Thies | 156/583.1 |
| 4,610,747 | A | * | 9/1986 | Bregenzer | 156/322 |
| 4,645,559 | A | | 2/1987 | Kaiser et al. | 156/583.1 |
| 4,721,542 | A | | 1/1988 | Schaublin | 156/353 |
| 4,728,385 | A | | 3/1988 | Hell | 156/353 |
| 4,897,147 | A | | 1/1990 | Inselmann | 156/498 |
| 5,158,132 | A | * | 10/1992 | Guillemot | 165/30 |
| 5,261,997 | A | | 11/1993 | Inselmann | 156/580 |
| 5,501,764 | A | | 3/1996 | Inselmann | 156/580 |

OTHER PUBLICATIONS

Kannegiesser; "Quality Fusing for Quality Fabrics"; 6 pages.
Brandwise Reliant Limited; "Powerbond High Performance Laminating Technology"; 8 pages.
Meyer; "Laminating Stabilizing Calibrating Coating"; 6 pages.

* cited by examiner

*Primary Examiner*—James Sells
(74) *Attorney, Agent, or Firm*—Stetina Brunda Garred & Brucker

(57) ABSTRACT

A laminating heating module for use in a flatbed laminating machine. The heating module comprises an elongate body portion with at least one heating pad attached thereto. The heating pad is fabricated from silicone rubber and includes three separate heating zones for regulating the heat to the body portion. Attached to each heating zone of the heating pad is a respective thermocouple to control the temperature of each heating zone. The heating module further comprises a thermostat attached to the heating pad and operative to protect the temperature of the body portion of the heating module from overheating.

10 Claims, 2 Drawing Sheets

LAMINATING HEATING MODULE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to lamination equipment for adhesively heat laminating two lengths of fabric to each other to form a laminated fabric product, and in particular to a flatbed fabric lamination machine having heating modules operative to adjust the heat applied to the fabric across the length of the heating module.

Fabric lamination is an extremely important process in the production of a myriad of goods. Such lamination generally involves the bonding of adjacent surfaces of two lengths of different textile products to each other with heat-sensitive adhesive. The two lengths typically are fed into a fabric lamination machine where both heat and physical pressure are applied to consequently activate the adhesive and bond the lengths of textile products together to form the laminated fabric product. Non-limiting examples of such laminated fabric products include garments with backings, wadding, decorative panels, carpets and draperies with backings and linings, furniture upholstery and bedding covers, and scores of other domestic and industrial commodities.

While fabric lamination machines are known in the art, these machines provide a single conveyor belt system of two rotating belts between which two lengths of fabric travel and are laminated by opposing pressured rollers after the lengths of the fabric are heated to a lamination temperature during belt travel in a heating zone. After such lamination, the resulting laminated product is cooled and made available for final use. The belts are heated in the heating zone through the use of upper and lower heater banks. Each upper and lower heater bank comprises a plurality of heater modules which provide heat to a respective moving conveyor belt. In this regard, the heater modules of the upper heater bank are positioned immediately above and in contact with the upper laminator conveyor belt, while the heater modules of the lower heater bank are positioned immediately below and in contact with the lower laminator conveyor belt. Typically, the heater modules comprise elongate rectangular extrusions that are placed laterally across the conveyor belt. Specifically, the heater modules are perpendicular to the direction of travel of the conveyor belt such that heat is directed across the width of the fabrics being laminated.

In heat lamination machines, the transfer of heat to the conveyor belt and the fabric must be uniform from the heater module in order to ensure a proper bond between the two textiles. Typically, in prior art heat lamination machines, the heating modules contain electric heating rods within three zones which transfer heat to the rectangular extrusion. However, the placement of the heating rods create "hot spots" within the extrusion which are undesirable. The "hot spots" are areas along the extrusion that do not have the desired temperature. Additionally, prior art heating modules do not allow for a prescribed temperature variation across the length of the extrusion. Specifically, the heating rods are placed across the length of the extrusion such that the heating module has the same temperature throughout the length thereof. Accordingly, it is not possible to vary the temperature in different zones of the heating module as may be necessary for the bonding of certain fabrics.

The present invention addresses the deficiencies in the prior art heat lamination machines by providing a heating module for a heat lamination machine that can accurately control the temperature of the conveyor belts. In this regard, the heating modules of the present invention evenly transfer heat across the width of the conveyor belts. The heating module of the present invention additionally provides lateral control of heat across the width of the conveyor belt for more precise control.

BRIEF SUMMARY OF THE INVENTION

In accordance with the preferred embodiment of the present invention, there is provided a laminating heating module for use in a flatbed laminating machine. The heating module comprises an elongate body portion having an interior chamber and a bottom wall. Typically, the body portion has a rectangular cross-sectional configuration. Disposed within the interior chamber on the bottom wall is an electric heating pad fabricated from silicone rubber and container a nickel-chrome heating element to provide uniform heat. The heating pad has three separate heating zones in order to provide lateral control of heat dissipation across the heating module. Attached to the heating pad at each respective heating zone is a thermocouple. Each thermocouple regulates the temperature of each of the heating zones. The heating module further includes a thermostat attached to the heating pad and operative to control the temperature of the heating zones to protect the heating pad from overheating.

Additionally, the present invention provides a method of regulating heat to a laminating heating module constructed in accordance with the preferred embodiment. The method comprises supplying electricity to the heating pad in order to heat such. Next, the temperature of each heating zone is regulated with a respective thermocouple. Finally, the temperature of the heating pad is protected with the thermostat.

BRIEF DESCRIPTION OF THE DRAWINGS

These as well as other features of the present invention, will become more apparent upon reference to the drawings wherein.

DETAILED DESCRIPTION OF THE INVENTION

Figure 1:
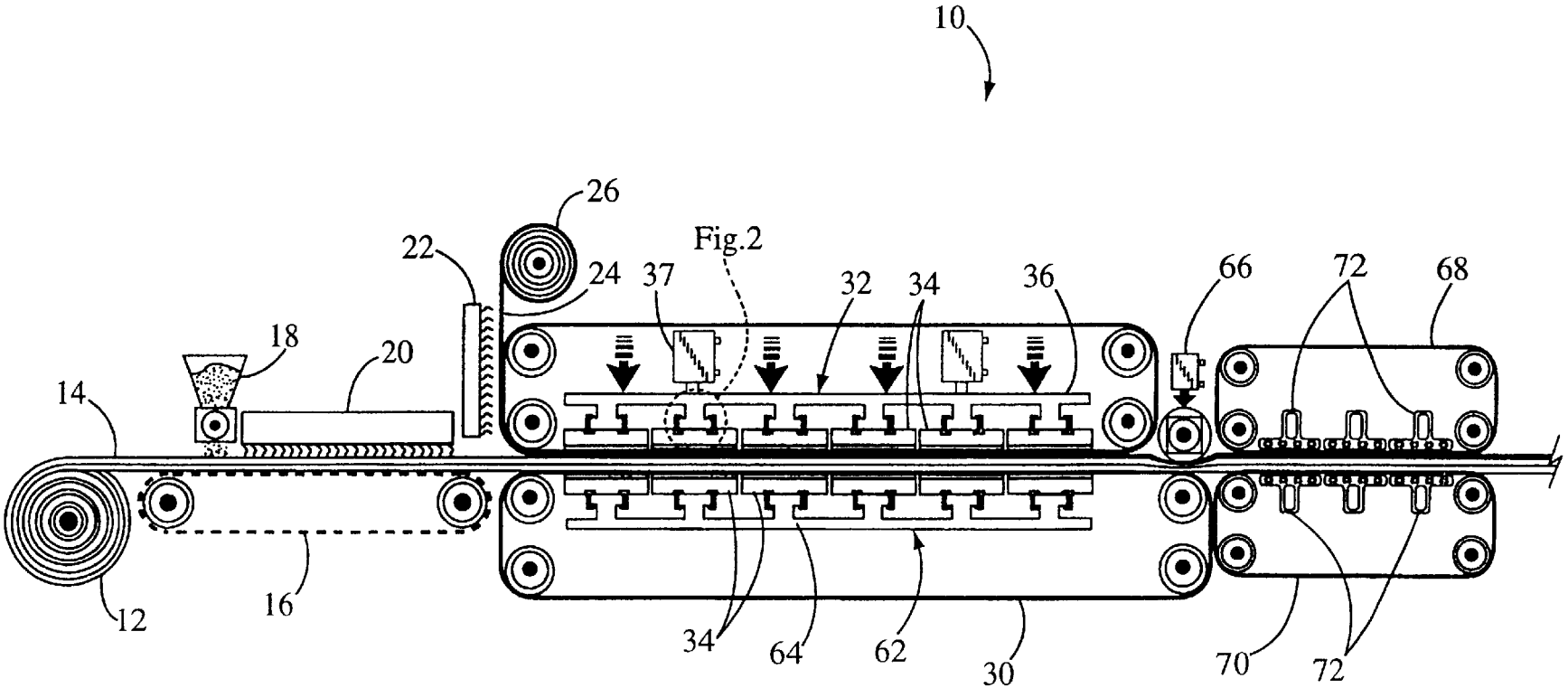
FIG. 1 is a cross-sectional view of a heat laminating machine having heating modules constructed in accordance with the preferred embodiment of the present invention.

Referring now to the drawings wherein the showings are for purposes of illustrating preferred embodiments of the present invention only, and not for purposes of limiting the same, FIG. 1 perspectively illustrates a heat laminating machine 10 used to manufacture laminated textile and wood products. The machine 10 includes a first roll 12 of a first material 14 disposed adjacent to an intermediate belt 16 that moves the first material under a scatterer 18. The scatterer 18 is positioned above the intermediate belt 16 and first material 14 and is operative to transfer an electrostatic powder onto a top surface of the first material 14 subsequent to the same being unrolled from the first roll 12. The intermediate belt 16 further moves the first material 14 into an infrared oven 20. The infrared oven 20 is disposed above the intermediate belt 20 and first material 14 in order to cure the powder on the first material 14. The powder may be an adhesive or other type of material and/or protectant. It will be recognized to those of ordinary skill in the art, that the scatterer 18 and infrared oven 20 are optional items that are not necessary for the proper operation of the machine 10.

The machine 10 is used to laminate the first material 14 to a second material 24. In this regard, the machine 10 further includes a second roll 26 of the second material 24, the second roll 24 being disposed above the first material 14. Upon being unrolled from the second roll 26, the second material 24 is passed over a pre-heater 22. The pre-heater 22 directs heat toward the bottom surface of the second material 24 in order for the second material 24 to reach a prescribed initial temperature.

After the second material 24 is heated to an initial temperature by pre-heater 22, the second material 24 is placed on the top surface of the first material 14 via an upper conveyor belt 28 and a lower conveyor belt 30. The upper and lower conveyor belts 28 and 30 are positioned within the heat laminating machine such that the bottom surface of the second material 24 is in laminar juxtaposition with the top surface of the first material 14. The width of each conveyor belt 28, 30 is greater than the width of the first material 14 and/or second material 24 in order to fully bond them together. The upper and lower conveyor belts 28, 30 additionally heat the first and second materials 14, 24 in order to heat activate any adhesive bond. As seen in FIG. 1, the upper conveyor belt 28 is in contact with an upper heater bank 32. The upper heater bank 32 comprises a series of heating modules 34 that are in contact with the upper surface of the upper conveyor belt 28 and supported by a rigid upper support frame 36. The upper support frame 36 positions the heating modules 34 in contact with the upper conveyor belt 28. The upper support frame 36 is attached to the heat laminating machine through two pneumatic pressure mechanisms 37, 37. The pressure mechanisms 37, 37 exert pressure against the upper support frame 36 to ensure that an air gap does not exist between the heating modules 34 and the upper conveyor belt 28, thereby leading to consistent heat transfer between the heating modules 34 and the upper conveyor belt 28.

Figure 2:
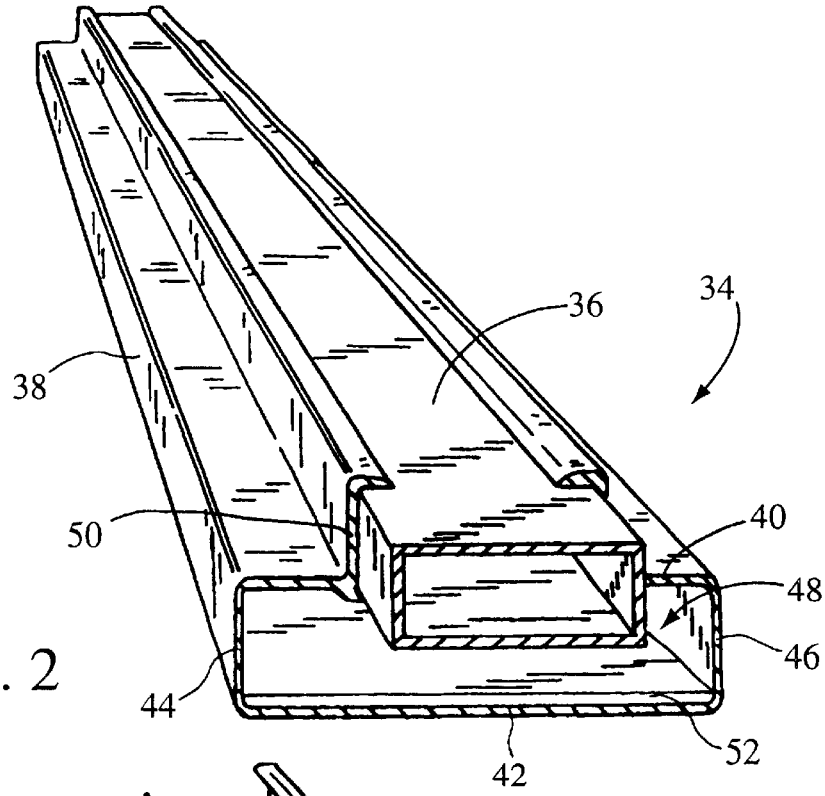
FIG. 2 is a perspective view of a heating module used in the heat laminating machine shown in FIG. 1.

As seen in FIG. 2, each of the heating modules 34 comprises an elongate, tubular body portion 38 having a top wall 40, a bottom wall 42, a left side wall 44, a right side wall 46 and an interior chamber 48 defined thereby. The top wall 40 is formed to include an opposed pair of channels 50 that are configured to receive the support frame 36. In this regard, the upper support frame 36 is preferably an elongate, rectangular tube, with the channels 50 being formed to have a complementary configuration such that the channels 50 can receive the upper support frame 36 and support the heating module 34. The body portion 38 has a length that is approximately equal to the width of the upper conveyor belt 28 thereby allowing each heating module 34 to laterally traverse the entire width of the upper conveyor belt 28 and provide heat fully across the same.

Figure 3:
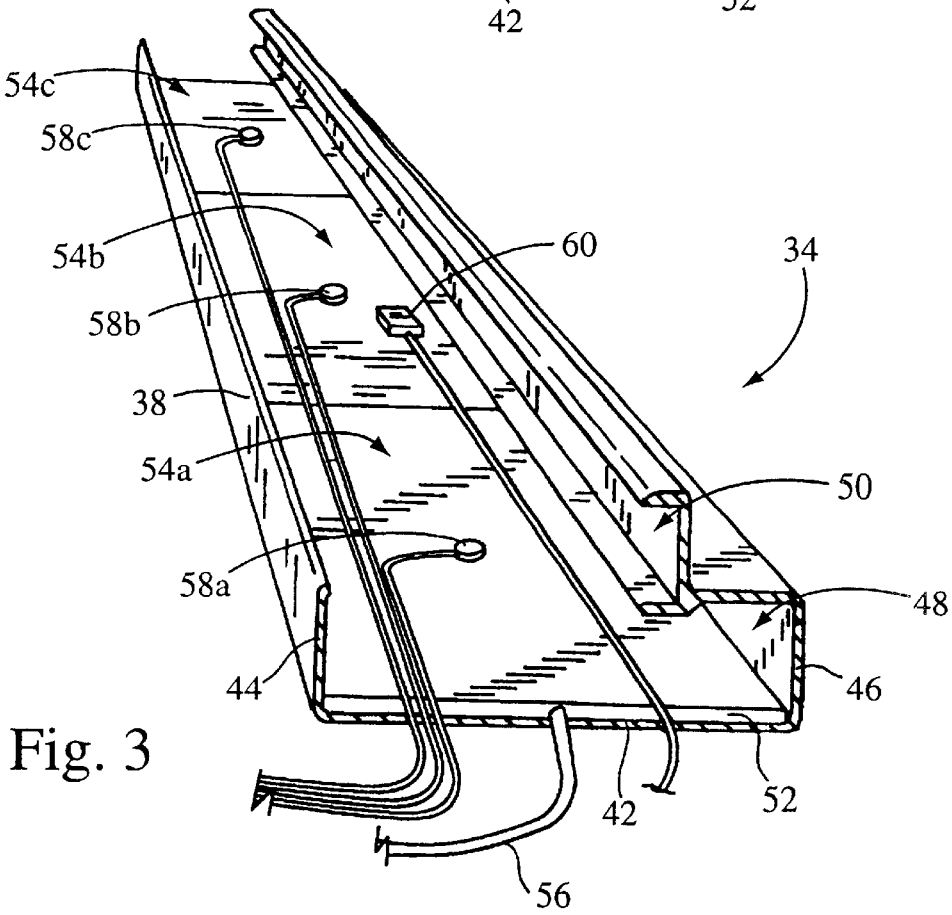
FIG. 3 is a cut-away perspective view of the heating module shown in FIG. 2.

In the preferred embodiment of the present invention, each heating module 34 includes a heating pad 52 disposed on the inner surface of the bottom wall 42. The heating pad 52 is fabricated from silicone rubber and preferably has heating elements fabricated from nickel-chrome that are capable of electrically heating the bottom wall 42 of the body portion 38. The heating elements are electrically connected to a power cord 56 that transmits electrical power to the heating pad 52 that converts such electrical power to thermal energy. The silicone rubber of the heating pad sufficiently disperses the heat from the nickel-chrome heating elements such that bottom wall 42 of the heating module 34 can be uniformly heated without hot spots. The heating pad 52 is segregated into three zones 54*a*, 54*b*, 54*c*, along the length of the body portion 38 of heating module 34, as seen in FIG. 3. The temperature of each of the zones 54*a*, 54*b*, and 54*c* can be independently monitored by respective thermocouples 58*a*, 58*b*, 58*c*. Each of the thermocouples 58*a*, 58*b*, and 58*c* are attached to the heating pad 52 in a respective zone 54*a*, 54*b*, and 54*c* and can monitor and control the temperature of such through the use of an electronic temperature controller (not shown). Each thermocouple 58*a*, 58*b*, and 58*c* is configured to regulate the heat dissipated by each of the zones 54*a*, 54*b* and 54*c* such that the temperature of each zone 54*a*, 54*b*, and 54*c* can vary according to the type of materials being bonded. Further, attached to the heating pad 52 is a thermostat 60 operative to protect the heating pad 52 from overheating due to failure of the thermocouples 58*a*, 58*b* and 58*c* or the electronic temperature controller. If the temperature of the heating pad 52 exceeds 400° F. at the location of the thermostat 60, then the thermostat 60 will remove power to all three zones 54*a*, 54*b*, and 54*c* of the heating pad 52. As seen in FIG. 3, the heating pad 52 includes three zones 54*a*, 54*b*, and 54*c*. However, it will be recognized to those of ordinary skill in the art that the pad 52 may include a fewer or greater number of zones depending upon the application.

As seen in FIG. 1, the heat laminating machine 10 comprises a lower heater bank 62 to transfer heat to the lower conveyor belt 30. The lower heater bank 62 is identically configured to the upper heater bank 32 and comprises six heating modules 34 attached to a lower support frame 64. As will be recognized by those of ordinary skill in the art, the number of heating modules 34 may vary, but the lower heater bank 62 and the upper heater bank 32 should contain the same number. The lower support frame 64 positions each of the heating modules 34 in abutting contact with the lower surface of the lower conveyor belt 30. The heating modules 34 therefore heat the lower conveyor belt 30 to a predetermined temperature in order to bond the first material 14 to the second material 24. The heating modules 34 of the lower heater bank 62 can control the temperature across the width of the lower conveyor belt 30 in order to ensure proper bonding as previously described for the upper conveyor belt 28.

The heat laminating machine 10 further includes a pressure roller 66 for applying pressure to the first material 14 and the second material 24 after heating thereof. The pressure roller 64 is disposed adjacent to the upper conveyor belt 28 and subsequent to the heating of the first material 14 and the second material 24. The pressure roller 64 ensures that the first material 14 is properly bonded to the second material 24.

Disposed adjacent to the pressure roller 64 and the lower conveyor belt 30 is an upper cooling conveyor belt 68 and a lower cooling conveyor belt 70. The upper and lower cooling conveyor belts 68 and 70 are positioned in the machine 10 to cool the first and second material 14 and 24 subsequent to heating and application of pressure by pressure roller 64. The upper and lower cooling conveyor belts 68 and 70 cool the first material 14 and the second material 24 in order to adhesively bond such together. In this regard, the laminating machine 10 further includes a series of cooling modules 72 in contact with the upper cooling conveyor belt 68 and the lower cooling conveyor belt 70. The cooling modules 72 are operative to cool the upper and lower conveyor belts 68 and 70 to a prescribed temperature and may be cooling tubes that contain a cooling fluid. After the first material 14 and the second material 24 have been cooled, the first material 14 and the second material 24 are bonded together to form the final product.

Additional modifications and improvements of the present invention may also be apparent to those of ordinary skill in the art such as varying the number of heating modules 34. Thus, the particular combination of parts described and illustrated herein is intended to represent only certain embodiments of the present invention, and is not intended to serve as limitations of alternative devices within the spirit and scope of the invention.

What is claimed is:

1. A method of regulating heat to a laminating heating module having an elongate body portion, an electric heating pad having three heating zones, three thermocouples attached to a respective one of the heating zones and a thermostat, the method comprising the steps of:

a) supplying electricity to the heating pad in order to heat such; and b) varying the temperature of each of the heating zones to a prescribed temperature with a respective one of the thermocouples.

2. A method of regulating heat to a laminating heating module having an elongate body portion, an electric heating pad having three heating zones, three thermocouples attached to a respective one of the heating zones and a thermostat, the method comprising the steps of:

a) supplying electricity to the heating pad in order to heat such; and b) controlling the temperature of the heating zones to a prescribed temperature with a respective one of the thermocouples.

3. The method of claim 2 further comprising the step of:

c) adjusting the temperature of the heating pad to a prescribed temperature with the thermostat.

4. A laminating heating module for use in a flatbed laminating machine, comprising:

an elongate body portion;

at least one heating pad attached to the body portion, each of the at least one heating pad having three separate temperature variable heating zones disposed adjacent to each other within the body along a length thereof; and at least three thermocouples for independently monitoring and variably controlling a temperature of each heating zone, each thermocouple being attached to a respective one of the heating zones of the heating pad and operative to regulate the temperature of each respective heating zone.

5. The module of claim 4 wherein:

the body portion comprises an interior chamber having a bottom wall ; and the heating pad is disposed within the interior chamber and attached to the bottom wall of body portion.

6. The module of claim 4 wherein the body portion is an elongate tube having a generally rectangular cross-sectional configuration.

7. The module of claim 4 wherein the heating pad is an electric heating pad.

8. The module of claim 4 wherein the heating pad is fabricated from silicone rubber.

9. The module of claim 8 wherein the heating pad includes a heating element fabricated from nickel-chrome.

10. The module of claim 4 wherein:

the laminating machine includes a support frame; and the body portion of the heating module comprises a channel formed therein for receipt of the support frame.

* * * * *